United States Patent [19]

Fruhwald

[11] Patent Number: 4,758,837

[45] Date of Patent: Jul. 19, 1988

[54] 4–20 MILLIAMPERE TRANSMITTER

[75] Inventor: John M. Fruhwald, Pittsburgh, Pa.

[73] Assignee: Bacharach, Inc., Pittsburgh, Pa.

[21] Appl. No.: 901,808

[22] Filed: Aug. 28, 1986

[51] Int. Cl.[4] ..... G08B 21/00; G08C 19/02

[52] U.S. Cl. ..... 340/870.16; 340/507; 340/652; 340/870.39

[58] Field of Search ..... 340/870.16, 870.39, 340/507, 506, 652, 870.17, 870.37

[56] References Cited

U.S. PATENT DOCUMENTS 3,492,589 1/1970 Rotier ..... 340/507
4,194,195 3/1980 Merrell et al. ..... 340/507

FOREIGN PATENT DOCUMENTS

WO82/00729 3/1982 PCT Int'l Appl. ..... 340/870.37

OTHER PUBLICATIONS

Tony Wang, Burr-Brown Corp. *Current Transmitter IC Cates to High-Level Signals and Tight Budgets,* Electronic Design, Apr. 18, 1985, pp. 165–174.
Burr-Brown Corporation; *Precision Voltage-To-Current Converter/Transmitter;* Nov. 1984, pp. 1–8.
Paul Brokaw, Analog Devices Inc., *Versatile Transmitter Chip Links Strain Gauges and RT Ds to Current Loop;* Electronic Design, Apr. 18, 1985, pp. 153–163.

*Primary Examiner*—John W. Caldwell, Sr.
*Assistant Examiner*—Alvin Oberley
*Attorney, Agent, or Firm*—Webb, Burden, Ziesenheim & Webb

[57] ABSTRACT

A transmitter circuit adapted to be connected to a sensor and generate a 4–20 milliampere signal proportional to the output of the sensor includes a first amplifier which is connected to the sensor and has an output voltage proportional to the sensor output voltage. A predetermined reference voltage is supplied to a reference input of the first amplifier. A second amplifier housing an output voltage responsive to a difference between its input voltages, has its output connected to the gate of an output transistor, preferably a fluid offset transistor. An output resistor is connected between the positive power supply and the source of the output transistor. The output of the first amplifier is supplied to the positive input of the second amplifier and the voltage at the source of the output transistor is supplied to the negative input of the second amplifier. The output current for the transmitter is generated at the drain of the output transistor. If any of the positive power supply wire, the current output wire or the common potential wire should break, the output current of this transmitter circuit drops to zero.

5 Claims, 1 Drawing Sheet

4–20 MILLIAMPERE TRANSMITTER

TECHNICAL FIELD

This invention is directed to transmitter circuits and, more particularly, to circuits used to transmit analog information.

BACKGROUND ART

The use of sensors to detect and measure temperature, gas concentrations and the like is well established in the art. Sensors are often positioned at remote or dangerous locations, such as in a mine or at the outlet of a smokestack, and the information measured by the sensors must be transmitted long distances, often up to one mile or more, to current meters. The signal produced by such a sensor is an analog signal covering a continuum of states and a standard has developed in the industry, as set by the Instrumentation Society of America, in which a 20 milliampere signal is transmitted for a full scale sensor reading, a 4 milliampere signal is transmitted for a zero sensor reading, and a proportional signal between 4 and 20 milliamperes is transmitted for a sensor reading between zero and full scale.

A variety of 4–20 milliampere transmitters are known in the art, such as the Burr-Brown XTR110 and the Analog Devices AD693. These transmitters typically include an instrumentation amplifier that references its output to the potential across the load and generates a measurable current related to the voltage developed by the sensors. The prior art designs require either a high voltage power source, or both a positive and negative power source to operate. The use of two power supplies is an obvious disadvantage and the use of a higher voltage is dangerous in certain environments.

It is, accordingly, an object of the present invention to provide a 4–20 milliampere transmitter which operates on a single, relatively low voltage power source.

Since the wires between the sensor and the current meter are often lengthy, it is desirable if the measured current drops to zero when a break in any wire occurs. If the sensor requires power from a remote source, three wire systems are used. These systems include a positive voltage wire, a current output wire, and a common wire. Prior art systems do not satisfactorily indicate a breakage of the common wire.

It is a further object of the present invention to provide a 4–20 milliampere transmitter which has a zero output current when any of the three conducting wires, and particularly the common wire, breaks.

It is desired to accomplish these objectives with a circuit that is suited to handling voltage transients and in which the number of components, including amplifiers, is kept to a minimum.

SUMMARY OF THE INVENTION

Accordingly, I have invented a 4–20 milliampere transmitter circuit which includes a first amplifier which receives the output voltage generated by a sensor. The first amplifier has an output voltage proportional to its input voltage. The circuit includes a voltage setting circuit for establishing a predetermined reference voltage supplied to a reference input of the first amplifier. The circuit also includes a second amplifier which has an output voltage responsive to a difference between its positive and negative input voltages. Each of the amplifiers is connected to a positive power source and a common potential. The circuit includes an output transistor having a source, gate and drain, with the gate connected to the output of the second amplifier. An output resistor is connected between the positive power supply and the source of the output transistor. The voltage at the source of the output transistor is supplied to the negative input of the second amplifier. A current is generated at the drain of the output transistor which is proportional to the output voltage of the sensor. According to the invention, only a single voltage supply is required for the transmitter. In addition, if any of the wires carrying the positive power, the output current, or the common potential are broken, the output current will drop to zero.

In a preferred embodiment, the output of the first amplifier is reduced by a resistor network, such as a pair of resistors connected in series between the output and the positive power supply, before it is supplied to the positive input of the second amplifier. In addition, the voltage setting circuit preferably includes a band gap reference circuit and a resistor connected in series between the positive power supply and the common potential. The positive side of the band gap reference is connected to the positive power supply and the voltage at the point between the band gap reference circuit and the resistor is supplied to the reference input of the first amplifier.

Preferably, the first amplifier is an instrumentation amplifier, the second amplifier is an operational amplifier, and the output transistor is a field effect transistor, such as a P channel enhancement field effect transistor. In addition, the sensor voltage is preferably supplied to the first amplifier in an inverted manner.

Other features and advantages of the transmitter circuit of the present invention will be apparent from the specification and the claims and from the accompanying drawings which illustrate the invention.

DETAILED DESCRIPTION OF THE PREFERRED EMBODIMENT

Figure 1:
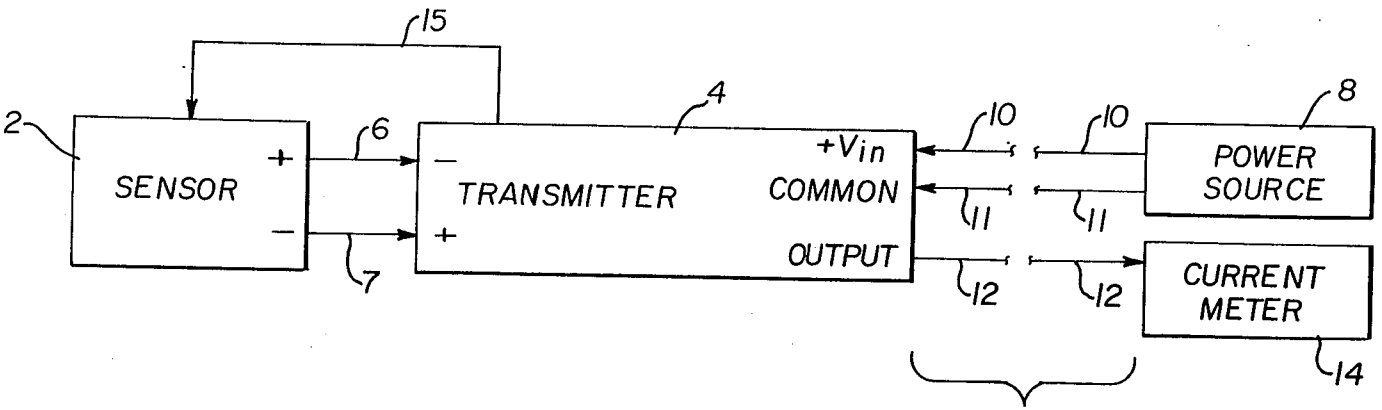
FIG. 1 is a block diagram showing a sensor system including the transmitter of the present invention.

A sensor system utilizing the 4–20 milliampere transmitter of the present invention is shown in block diagram format in FIG. 1. Sensor 2 is positioned in the vicinity of a substance to be monitored. For example, sensor 2 may be an $H_2S$ sensor or a combustible gas sensor positioned within a gaseous environment. The sensor 2 produces a voltage which is supplied to the input of a transmitter 4 positioned, preferably, in the same location as the sensor 2. In the present invention, the voltage generated by the sensor 2 is supplied directly to an amplifier in transmitter 4 in an inverted manner. Therefore, the positive output voltage of sensor 2 is supplied to the negative input of transmitter 4 via wire 6 and the negative output voltage of sensor 2 is supplied to the positive input of transmitter 4 via wire 7.

The power for transmitter 4 is supplied from a power source 8 by power wire 10 and common wire 11. The output current from the transmitter 4 is supplied via wire 12 to a current meter 14. If the sensor 2 requires electrical power for its operation, this may be supplied from transmitter 4 via wire 15. For example, a common $H_2S$ sensor requires electrical power for both the heater and the sensing element contained therein. Wires 10, 11 and 12 are drawn as broken in FIG. 1 to indicate the distance between sensor 2 and transmitter 4 at one end of the system and power source 8 and current meter 14 at the other end of the system.

Figure 2:
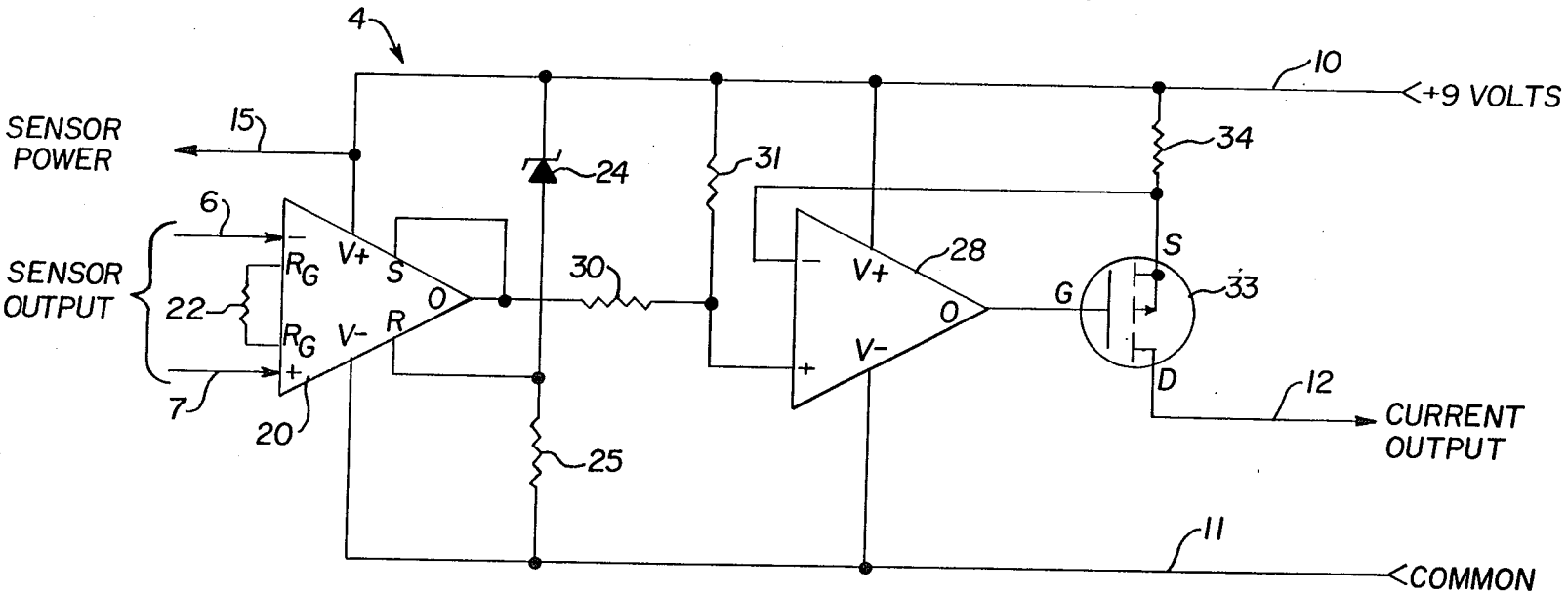
FIG. 2 is a circuit diagram showing the 4–20 milliampere transmitter of the present invention.

FIG. 2 shows a preferred circuit arrangement of the 4–20 milliampere transmitter in accordance with the present invention. The transmitter 4 includes a first amplifier 20 which has an output voltage proportional to the voltage supplied across its positive and negative inputs. As shown, the negative output of the sensor is supplied via wire 7 to the positive input of amplifier 20, while the positive output of the sensor or a reference voltage is supplied via wire 6 to the negative input of amplifier 20. In this manner, the output voltage of the sensor 2 is inverted before it is supplied to the first amplifier 20. The first amplifier 20 is preferably an instrumentation amplifier, such as an AD624 or an AMP01. The input terminals of the first amplifier 20 may be shunted by resistor 22, if desired.

The positive supply voltage from the power source is supplied from wire 10 to the positive power input (V+) of the first amplifier 20, while the negative power input (V−) of amplifier 20 is connected directly to the common wire 11. The output of the first amplifier 20 is fed back to its sense input S. A band gap reference circuit 24 extends in series with resistor 25 between the positive supply wire 10 and the common wire 11, with the positive terminal of the band gap reference 24 connected to wire 10 and resistor 25 connected to the common wire 11. The voltage at the point of connection between band gap reference 24 and resistor 25 is supplied to the reference input R of the first amplifier 20. A suitable band gap reference is Linear Technology LT1004 having a reference voltage of about 1.235 volts. Resistor 25 should be large enough to provide a sufficient current to bias the band gap reference 24.

The transmitter 4 shown in FIG. 2 also includes a second amplifier 28, preferably a differential operational amplifier such as a LM107. The second amplifier 28 responds to a difference between the positive and negative input voltages and changes its output voltage by an amount sufficient to cause the positive and negative inputs to become balanced. Resistors 30 and 31 extend in series between the output of the first amplifier 20 and the positive supply voltage at wire 10. The output voltage of the first amplifier is reduced by the resistor network of resistors 30 and 31 and the voltage drop across resistor 31 is supplied to the positive input of the second amplifier 28. The positive supply voltage is supplied from wire 10 to the positive power input (V+) of the second amplifier 28, and the negative power input (V−) of the second amplifier 28 is connected to the common wire 11.

The output from the second amplifier 28 is supplied directly to the gate of an output transistor 33 and controls its conductance. Output transistor 33 is preferably a P channel enhancement field effect transistor. Suitable transistors include TP0104N2 and VP0808B, for example. An output current monitoring resistor 34 is connected between the positive supply voltage at wire 10 and the source of the transistor 33. The voltage at the source of transistor 33 is fed back to the negative input of the second amplifier 28. The output current generated by the transmitter circuit 4 is taken from the drain of the output transistor 33 to wire 12.

The output voltage of the first amplifier 20 is proportional to the output voltage of the sensor 2. The voltage across the output resistor 34 must be increased when the sensor output voltage increases, and thus result in an increased output current from the drain of the output transistor 33. In order to do this, the voltage at the source of the transistor 33 and, hence, at the negative input to the second amplifier 28 must be lowered. To lower this voltage level, i.e., pull it closer to the common circuit potential, the voltage output from the first amplifier 20 to the positive input of the second amplifier 28 must be reduced in response to an increased sensor output voltage. Hence, the sensor output voltage is supplied to the first amplifier 20 in an inverted sense as described above.

When the sensor 2 has its zero condition output, i.e., nothing has been detected by the sensor 2, then the output of the first amplifier 20 will be equal to the voltage supplied at the reference input R. This voltage will equal the most positive supply potential minus the reference voltage of the band gap reference 24. In a preferred embodiment, the positive supply voltage is +9 volts and the reference voltage of band gap reference 24 is about 1.235 volts. The voltage supplied to the positive input of the second amplifier 28 is determined by the divider network of resistor 30 and resistor 31. The voltage at the resistor 31 end of the resistor network is the positive supply voltage while the voltage at the resistor 30 end, connected to the output of the first amplifier 20, is the positive supply voltage minus the voltage of band gap reference 24. The voltage drop across resistors 30, 31 is the difference between these voltages or is equal to the voltage of band gap reference 24. The voltage supplied to the positive input of the second amplifier 28 is the voltage across resistor 31 and is equal to $$\frac{\text{Resistor 31}}{\text{Resistor 30} + \text{Resistor 31}} \times \text{Voltage of band gap reference 24.}$$

In a preferred embodiment, the voltage of band gap reference 24 is about 1.235 volts, resistor 31 is 1 K and resistor 30 is 2.08 K. The voltage supplied to the positive input of the second amplifier 28 is $$1.235 \text{ volts} \times \frac{1\text{ K}}{2.08\text{ K} + 1\text{ K}} = 0.4 \text{ volts.}$$

By supplying a 0.4 volt signal to its positive input, the second amplifier 28 will generate an output voltage sufficient to increase the conductance of transistor 33 until the voltage at the source of the transistor 33 and, thus, at the negative input of the second amplifier 28 is equal to the 0.4 volt signal at the positive input. In this manner, the inputs to the second amplifier 28 are balanced and a steady state is reduced. By selecting the output resistor 34 to equal 100 ohms, a 4 milliampere current will pass through transistor 33 and out of the drain via output wire 12. Thus, the transmitter 4 will generate the desired 4 milliampere signal when the sensor output is zero.

As the sensor output increases, the output of the first amplifier 20 will decrease toward the common potential, thus increasing the voltage supplied to the positive input of the second amplifier 28. The second amplifier 28 will drive the gate of the output transistor 33 to increase its conductance and increase the current flow until the voltage drop across the output resistor 34 and, hence, the voltage at the negative input of the second amplifier 28 is increased to match the increased voltage at its positive input. Therefore, the output current through the drain of the output transistor 33 will increase with increased sensor output voltage.

In theory, the maximum voltage supplied to the positive input of the second amplifier 28 is $$9 \text{ volts} \times \frac{1}{1 + 2.08} \text{ or } 2.9 \text{ volts.}$$

This would occur when the first amplifier 20 saturates to the common potential and results in a maximum output current of $$\frac{2.9 \text{ volts}}{100 \text{ ohms}} \text{ or } 29 \text{ mA.}$$

In practice, the output of the first amplifier 20 does not reach the common potential, but will reach a minimum of at least 3 volts. The drop across resistors 30 and 31 will be at least 6 volts (9 volts−3 volts) and the maximum voltage supplied to the positive input of the second amplifier 28 will be at least ⅓ of 6 volts or 2 volts. Thus, the voltage across the output resistor 34 at full sensor output and at steady state will be a minimum of 2 volts. With resistor 34 set at 100 ohms, the output current will be 20 milliamperes.

If any of the wires connected to the transmitter 4 were to break, then the output current would go to zero. A break in the output wire 12 will prevent current flow and give a zero current reading. A break in the positive power supply wire 10 will stop all power to the sensor 2, amplifiers 20, 28 and output transistor 33 and will provide no output current at the drain of transistor 33. If the common wire 11 were to break, then the second amplifier 28 would generate no output signal, the transistor 33 woud be non-conductive from the lack of turn on voltage to the gate, and the output current would drop to zero because the transistor 33 is off. The gate of the transistor 33 is insulated from the source and drain so there can be no output current. Thus, the transmitter circuit of the present invention operates with a single, lower voltage level, produces an output current in the standard 4–20 milliampere range, and indicates when any of the three connecting wires is broken by giving a zero current output.

Having described above the presently preferred embodiment of the invention, it is to be understood that it may be otherwise embodied within the scope of the appended claims.

I claim:

1. A transmitter circuit comprising an instrumentation amplifier adapted to receive the output voltage of a sensor in an inverted manner and having an output voltage proportional to its input voltage and having its output voltage supplied to a sense input on said instrumentation amplifier, a voltage setting means for establishing a predetermined voltage to a reference input of said instrumentation amplifier, an operational amplifier having an output voltage responsive to a difference between its positive and negative input voltages and having its positive input connected to the output of said instrumentation amplifier, with each of said amplifiers connected to a positive power supply via a positive power supply wire and to a common potential via a common potential wire, said circuit further including an output transistor having a source, drain and gate and with the gate connected to the output of said operational amplifier, an output resistor connected between said positive power supply and the source of said output transistor, with the voltage at the source of said output transistor supplied to the negative input of said operational amplifier, said voltage setting means including a band gap reference circuit and a resistor connected in series between said positive power supply and said common potential, with the band gap reference circuit connected to said positive power supply, and with the voltage between said band gap reference circuit and said resistor supplied to the reference input of said instrumentation amplifier, wherein an output current is generated on a current output wire at the drain of said output transistor which is proportional to the output voltage of said sensor, and whereby the output current drops to zero upon breakage of said positive power supply wire or said current output wire or said common potential wire.

2. The transmitter circuit of claim 1 wherein the output of said instrumentation amplifier is reduced by a resistor network before being supplied to the positive input of said operational amplifier.

3. The transmitter circuit of claim 2 wherein said resistor network includes two resistors connected in series between the output of said instrumentation amplifier and the positive power supply, and the voltage across one of said resistors is supplied to said operational amplifier.

4. The transmitter circuit of claim 1 wherein said output transistor is a field effect transistor.

5. The transmitter circuit of claim 1 wherein said output transistor is a P channel enhancement field effect transistor.

* * * * *